US008926320B2

(12) United States Patent
Al Gharib

(10) Patent No.: US 8,926,320 B2
(45) Date of Patent: Jan. 6, 2015

(54) LIGHTER AND METHOD FOR ELIMINATING SMOKING THAT INCLUDES INTERACTIVE SELF-LEARNING SOFTWARE

(76) Inventor: Samer Elias Al Gharib, Metn (LB)

( * ) Notice: Subject to any disclaimer, the term of this patent is extended or adjusted under 35 U.S.C. 154(b) by 570 days.

(21) Appl. No.: 13/403,492

(22) Filed: Feb. 23, 2012

(65) Prior Publication Data

US 2012/0214107 A1 Aug. 23, 2012

Related U.S. Application Data

(60) Provisional application No. 61/445,721, filed on Feb. 23, 2011.

(51) Int. Cl.
*A24F 47/00* (2006.01)
*F23Q 2/32* (2006.01)

(52) U.S. Cl.
CPC ..... *F23Q 2/325* (2013.01); *A24F 47/00* (2013.01)
USPC ..... 431/253; 431/142; 431/14; 431/86; 131/270; 702/177; 968/977

(58) Field of Classification Search
CPC ..... A24F 15/005; F23Q 2/32; F23Q 2/325
USPC ..... 431/2, 14, 86, 253; 131/270; 702/177; 968/977
See application file for complete search history.

(56) References Cited

U.S. PATENT DOCUMENTS

| | | | | |
|---|---|---|---|---|
| 3,735,099 | A * | 5/1973 | Herr | 235/91 R |
| 4,111,638 | A * | 9/1978 | Ostberg | 431/13 |
| 4,311,448 | A | 1/1982 | Strauss | |
| 4,853,854 | A * | 8/1989 | Behar et al. | 700/295 |
| 6,606,997 | B2 * | 8/2003 | Brue | 131/270 |
| 6,693,850 | B2 * | 2/2004 | Mulaw | 368/10 |
| 6,839,305 | B2 * | 1/2005 | Perlman et al. | 368/109 |
| 7,015,796 | B2 * | 3/2006 | Snyder | 340/309.16 |
| 2001/0027794 | A1 * | 10/2001 | Brue | 131/270 |
| 2005/0141346 | A1 * | 6/2005 | Rawls et al. | 368/10 |
| 2008/0160463 | A1 * | 7/2008 | Biriki | 431/2 |

* cited by examiner

*Primary Examiner* — Jorge Pereiro
(74) *Attorney, Agent, or Firm* — Shlesinger Arkwright & Garvey LLP

(57) ABSTRACT

Smoking cessation lighter is configured for lighting cigarettes for a smoker, and learning software is provided for monitoring smoking behavior of a smoker during a first data collection period and guiding a smoker's smoking cessation by directing the smoker when the smoker is to smoke a cigarette based on data collected during the first data collection period. The learning software monitors user behavior and collects data during use of the lighter by the smoker after the initial data collection period in order to analyze and further guide the smoker based on the smoker's cheating behavior, the smoker's behavior of lighting a cigarette for a friend, and the smoker's behavior of skipping use of the lighter at a time when the smoker has been directed to light a cigarette by the lighter.

11 Claims, 3 Drawing Sheets

LIGHTER AND METHOD FOR ELIMINATING SMOKING THAT INCLUDES INTERACTIVE SELF-LEARNING SOFTWARE

CROSS REFERENCE TO RELATED APPLICATIONS

This application claims the priority of U.S. application No. 61/445,721, filed Feb. 23, 2011, and which is incorporated herein by reference.

FIELD OF THE INVENTION

This invention relates to a lighter that is used by smokers to reduce the number of consumed cigarettes by tracking the user's smoking behavior, and providing feedback based on such data. More particularly, the invention relates to a lighter which is used by smokers to reduce the number of consumed cigarettes gradually by controlling the habit through a smart descending algorithmic reminder notification system, namely by use of a self-learning or learning software system which tracks user smoking behavior, and which uses such tracked smoking data to provide feedback to a user; i.e., to a smoker using the lighter.

BACKGROUND OF THE INVENTION

It is well known that smoking, such as cigarette and cigar smoking, is a health hazard and that many individuals who smoke are trying to quit smoking. It is likewise well known and medically accepted that it is not easy for smokers to stop smoking without an aiding or assisting device or a smoking substitute.

Known devices include nicotine patches, nicotine gums, electronic nicotine cigarette, the drug 'Champix', and a changing taste spray.

Known ways of quitting smoking do not treat the habit itself with all the sensations it engenders in a smoker; they only substitute a nicotine substance for a cigarette. These solutions are not always a definitive cure. It is usually a transitory phase for the quitter and recidivism may occur; i.e., the smoker may start smoking again. In addition, some of these methods include irritating side-effects including nausea, vomiting, cravings, and weight gain.

U.S. Pat. No. 4,311,448 to Strauss is directed to a "Smoking Elimination Guidance System."

Known devices have a variety of drawbacks.

OBJECTS AND SUMMARY OF THE INVENTION

It is an object of the invention to overcome the drawbacks of the prior art.

It is an object of the invention to provide a lighter which not only controllably reduces the number of cigarettes consumed by a smoker, but which also keeps track of cigarettes actually smoked by a smoker, whether or not the smoker smokes at the prescribed times or non-prescribed times (i.e. "cheats") but also provides for the possibility that the smoker can light a cigarette for another person, such as a friend, without that use of the lighter counting as a use for lighting the smoker's own cigarette.

It is an object of the invention to provide a lighter which includes a learning software; that is, software which is programmable, interactive, and self-learning, also known as self-teaching, such as by tracking a user's input and changing the output of the device controlled by the smart software responsive to the user's input or, indeed, the user's use of the device incorporating the software.

It is another object of the invention to provide a device which includes software which accepts explicit input by the user or tracks the user's use of the device and makes changes based on the tracked use without specific user commands (inputs).

It is another object of the invention to provide a device which includes a way to provoke a conditioning effect.

Another object of the invention is to provide a lighter which works on the psychological level i.e. information and data given to change user's behavior.

Another object is to provide a lighter which can calculate whenever the user is cheating or skipping.

Another object is to provide a lighter which includes a way to readily share or download data, such as with an external connection, such as a USB port to download data onto a computer, or other device, to share and keep data for multi-purpose use, e.g. to collect global statistics of multiple user's behavior and evolution and changes in behavior around the world.

Another further object is to provide a lighter which includes a way to include the possibility to light a cigarette for a friend without counting the actuating of the lighter as an actuation of the lighter for the user to light his own cigarette.

Still further objects of the invention include the providing of:

1. a butane gas lighter with a controlled igniter;
2. an electronic circuit board including a central processing unit (CPU) and flash memory;
3. a USB port or other standard interface for connecting to a computer or telephone, such as a cell phone;
4. self-learning or learning software;
5. a digital screen;
6. control buttons;
7. a speaker to play audio notifications;
8. a rechargeable battery;
9. a silent user alert, such as a light notification (e.g. a red light) that may blink in the case when the user is using the lighter in a silent mode;
10. a further silent user alert, such as a vibrating device, for use with a vibrate option, which may also notify the user if the sound notification is put in a silent mode, or is put on a low volume mode;
11. a smart phone application with which a user may link the inventive lighter to the user's online profile;
12. a further smart phone application by which the user may recharge the battery of the inventive lighter when it is low by using the smartphone battery;
13. a still further smart phone application with which a user may link the inventive lighter to the user's smart phone to update user data;
14. another smart phone application with which a user may link the inventive lighter to the user's smart phone to provide for the user finding a misplaced inventive lighter in the case it is lost; e.g., a button on the user's smart phone may be pressed for emitting a signal receivable by the inventive lighter so that the lighter will beep to assist the user in finding the lighter;
15. Still further, another object is to provide a software program by which the user's lighter use statistics are tracked and available to the user, depending on the intended use;
16. on the statistical side a component which is used for predicting the intention to quit smoking according to user behavior; and
17. an online backup portal and community gathering.

It is another object of the invention to provide a lighter for the marketplace which is a lighter with learning software; i.e., which is a lighter having a smoking habit registry system (behavior recording system) and conditioning notification, in addition to the lighter being capable of being a statistical smoking behavior recording meter; e.g., device.

In summary, the invention is directed to a lighter with learning software which helps a smoker to limit and reduce the number of cigarettes until he or she quits smoking gradually, by acting on his or her behavior, such a tracked behavior with feedback from the lighter to the user.

The invention further includes:

A smoking elimination lighter including a lighter having interactive software; i.e., learning software, which records actual smoker usage (i.e. lighting of cigarettes), but which also tracks the number of cigarettes smoked at predetermined times set by the software of the computerized lighter, while also providing for the smoker to light a cigarette for another person without that type of lighting of a cigarette (i.e., use of the lighter) counting as a cigarette smoked by the user himself.

The smoking elimination cigarette lighter includes, comprises, consists of, or consists essentially of, a lighter controlled by learning software aiming to help the smoker reduce the number of consumed cigarettes gradually until, ideally, quitting smoking. Its self-learning software records the smoking habits of the user for one week, for example, then schedules, in accordance with the recorded user smoking data, for the user.

For example, after the initial predetermined learning period, such as one week of recorded user smoking data, the user is given an audio signal periodically by the inventive lighter to light a cigarette, and the user gradually enters a conditioning phase. This conditioning phase or process provides for controlling the user's behavior guiding him or her, indeed causing him, to diminish his cigarette consumption gradually as the software reduces the frequency of the notifications.

As used herein, the term self-learning software may be understood to mean software which tracks inputs from a user, such as a smoker in accordance with the invention, and then records the inputs, and makes predetermined calculations based on those inputs, for providing feedback, such as in the form of alerts as to when a smoker is to (i.e. may) smoke a cigarette (i.e., may smoke a cigarette) in accordance with the data recorded and analyzed by the self-learning software.

Such self-learning software is likewise termed learning software, as will be readily understood by a person having ordinary skill in the art. This learning software in accordance with the invention has features, as will be readily appreciated, akin to teaching software in that it teaches a user i.e. a smoker, when the smoker may smoke another cigarette.

In accordance with the invention, the learning software is directed to tracking and analyzing a user's smoking behavior, and then guiding the user in acceptable smoking behavior; and, eventually, assisting the user in quitting smoking. The learning software likewise tracks and changes its outputs (e.g. in the form of commands to the user) based on smoking behavior after the initial data collection period, prior to initiation of the user conditioning and user diminution period and period of the smoking cessation program. The learning software as used herein likewise refers to the software algorithm including the possibility that the user will avoid smoking a cigarette even when the learning software has directed the smoker that it is acceptable to smoke a cigarette, as well as recording when a user has used the lighter to light a cigarette when the user has not been directed to light a cigarette. In that case, the user may be using the lighter to light a cigarette for various reasons; e.g., to cheat or uses the lighter for a purpose other than to smoke himself, such as for a "friend."

As used herein, the term "cheat" means that the smoker has used the lighter to smoke a cigarette at a time when the smoker has not received a command from the learning software that it is now a time in which the smoker may light a cigarette in accordance with the smoking cessation program.

As used herein, the term "friend" means that the person for whom the lighter is being used is someone other than the user himself, whether that person be a friend in the strict sense of the word, an acquaintance, a business person, or a stranger on the street, for example, who requests that the user of the inventive lighter light the stranger's cigarette.

As used herein, the term software means software which may be written as computer code specifically for the lighter, existing learning decision tree software, known self-learning or learning programs or software, whether or not provided on a dedicated chip, and whether or not such existing learning software or dedicated chip requires modification, such as by eliminating or modifying existing decision pathways on the chip prior to use of the logic chip in the inventive lighter. Such will be readily understood by a person having ordinary skill in the art.

Still further, it will be appreciated that relative terms such as up, down, left, and right are for convenience only and are not intended to be limiting.

DETAILED DESCRIPTION OF THE INVENTION

Figure 1:
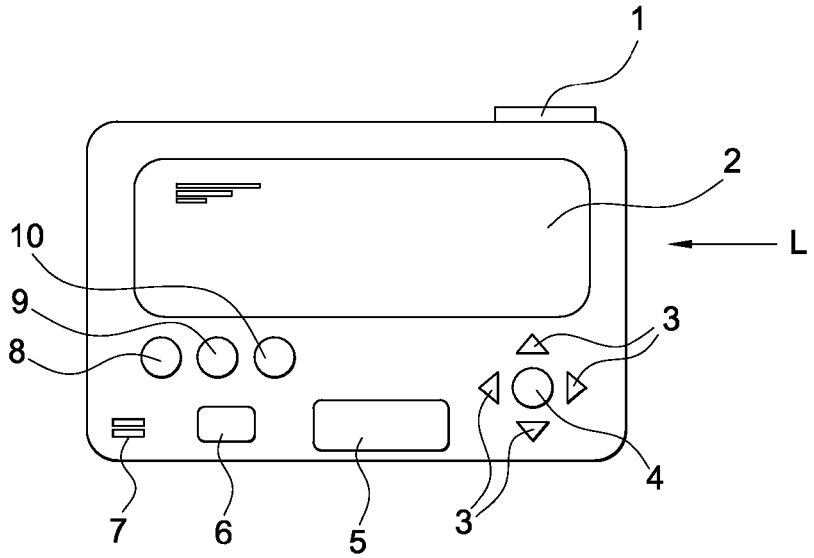
FIG. 1 is a front view of an embodiment of a handheld smoking elimination lighter in accordance with the invention that includes interactive learning software.
Figure 2:
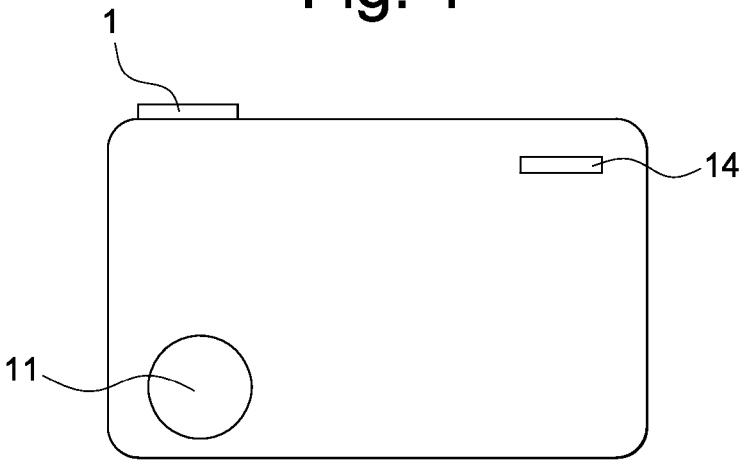
FIG. 2 is a rear view of the embodiment of a handheld smoking elimination lighter of the embodiment of FIG. 1.
Figure 3:
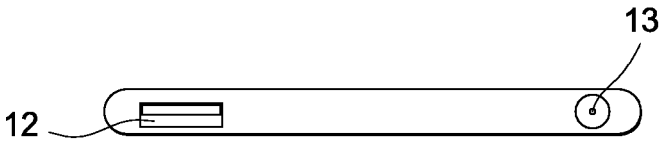
FIG. 3 is a bottom view of the embodiment of FIG. 1 of a smoking elimination lighter.

FIG. 1-3 illustrate an embodiment of a handheld smoking elimination lighter L including various inputs devices, such as buttons, and lighter components, such as an fuel ignition actuator or ignition button 1 used to ignite the lighter and light a cigarette, as will be readily understood.

Smoking elimination lighter L may further include a display, such as a digital screen 2 for displaying questions, starting date, date and time, showing the next cigarette smoking time for the user, and other smoking statistics, depending on the intended use and the user, such as displaying the time, if the cigarette timing was delayed, or if unscheduled smoking has occurred, progress line and other information.

Directional buttons or keys 3 for the user to move to different portions of the display for entering data, or for accessing information accessible from the learning software may be provided, such as the illustrated up, down, left and right buttons 3. Such may be used to navigate in a menu provided on the display, and enter user information, such as numbers, as will be readily appreciated by a person having ordinary skill in the art.

An accept or OK button 4 may be provided for the user to select or confirm an option.

A menu button or key 5 may be provided for the user to access the menu lists and different settings and reports.

A silent button or key 6 may be provided for the user to disable the audio signal, and replace it with a vibration notification, for example.

A speaker 7 may be provided for the user to produce audio notifications announcing the scheduled smoking times.

A skip button 8 may be provided for the user to press when the smoker intends to skip a scheduled cigarette. In that manner the user may positively record that the scheduled cigarette has been skipped, as opposed to the case when the user has not smoked a cigarette because the user has not smoked the allowed scheduled cigarette at the scheduled time. For example, when lighter L is on but not in the user's possession.

A friend button 9 may be provided for the user to press, when intending to light a cigarette to another person; in that manner the software does not count the occurrence.

A cheat key or button 10 may be provided for the user to actuate, such as by pressing, when the smoker intends to smoke an additional unscheduled cigarette, and the user wants the learning software to be notified that the unscheduled cigarettes has been smoked so that the learning software has been given the complete data on the user's behavior.

A battery 11 may be provided for the user to replace or renew the power source, such as a rechargeable battery.

A USB 2.0 port 12 may be provided for the user to connect the inventive lighter L to a USB link to transport data to and from the user's computers in order to share or restore them at any time they want.

A refill port 13 or hole may be provided for the user to refill the lighter with a lighter fuel, such as butane gas.

An On/Off actuator or button 14 may be provided for the user to control switching the device on or off.

An embodiment of the invention of a smart cigarette lighter system and method includes, or consists of, a smart lighter aiming to help the smoker to limit and reduce the number of cigarettes consumed until quitting smoking. The lighter is equipped with innovative software that schedules the smoking times, by giving its user an audio warning signal, e.g., audio alert, to light a cigarette. This process aims to achieve that the smoker lights a cigarette only when he/she hears the periodic audio alert; then, whenever the user is conditioned, the smart software will start to reduce the number of cigarettes by reducing the frequency of audio alerts until achieving the end goal of the user quitting.

The lighter L may be a butane gas lighter with an ignition button, equipped with a computerized system, such as self-learning or learning software, and may include a CPU and flash memory, a USB port to upload and download data to a personal computer, and several buttons actionable by the user. Its software controls its mechanical parts, especially the ignition button, to record the actions and allow/disable its operation. Its memory saves user profile data, user smoking behavior and its smart algorithm will produce scheduled audio notifications to condition the user to smoke when allowed. Once the user is conditioned and sticks to the scheduled cigarette, the software will gradually reduce its number of allowed cigarettes per day.

The user is allowed to use it as a normal lighter and bypass the restriction by the use of the "cheat" and "friend" buttons, to smoke an unscheduled cigarette and use it to light other's cigarettes respectively.

Still further, directional buttons 3, for the user to move to different parts of the display 2, such as the illustrated Up, Down, Left and Right buttons are used to navigate in the menus, such as on display screen 2, and to move to a desired screen/menu location, such as to provide access to a user to input numbers, e.g., user data, into the software.

Friend button 9 is pressed by the user, when intending to light a cigarette for another person; in this way the software does not count the occurrence of using the lighter as the lighting of a cigarette for the user himself.

Cheat button 10 is used when the smoker intends to smoke an additional unscheduled cigarette; that is, used when the user confirms that he is lighting a cigarette for himself. It will be readily appreciated that cheat button 10 coupled with friend button 9 provide for a previously unknown enhanced accuracy so that the lighter use collects data based solely on the user's own cigarette smoking habits. In other words, clean, unskewed data is collected which enhances not only the accuracy of the data, but also the user's experience and faith in the system that leads to enhanced compliance.

Operation

Phase One: Profile Data and Behavior Recording Period

The learning software of lighter L, according to an embodiment of the invention, requires, when first turned-on or started, that the user inputs setup data, for example:

Current Date and Time

Age and Gender of the user

Age of starting smoking

Approximate number of cigarettes smoked per day

Select the preferred audio notification tone

After entering the above-mentioned information, and user pressing the start confirmation in the menu, the software will record the smoking behavior of the user for a period of seven days, saving smoking times during these days.

Phase Two: Conditioning and Smoke Diminution Period

At the 8th day (end of behavior recording phase and starting the effective process), the software will ask user to confirm the number of cigarettes smoked daily by comparing with recorded daily average.

The regular lighter ignition switch ceases to function unless activated by software as per below.

At each beginning of day, the software calculates the automatic smoking notification schedule as per quantity defined per user (and altered by software as below) and according to recorded behavior. The lighter software becomes operational in the standby mode.

Knowing that the user is allowed to put the number of the desired and usually consumed cigarettes, the software will start giving scheduling for him the submitted number through an audio signal according to his particular pattern of smoking. Following the audio signals, i.e. smoking when the signal is received, is the recommended smoking behavior in order to enter the conditioning. The user should normally feel no frustration or eagerness to smoke as he continues to smoke the same number of cigarettes at the times he as accustomed to. But like any human being the smoker is tempted and could cheat from time to time. Therefore a cheat button is provided to give him this opportunity i.e. to light a cigarette at an unscheduled time. To stop cheating means that the user is ready to enter the conditioning phase. Another button is provided to give the user the chance to skip a cigarette whenever he is not able to smoke or does not feel the need. Pressing the skip button means that the user cannot light a cigarette at this particular moment and/or does not desire one. In both cases whenever cheat or skip button is pressed, the software will reschedule the interval of the remaining cigarettes.

Therefore while the lighter is active and in standby mode, one of three actions occurs:

1. Software beeps notifying the next cigarette of the day according to the behavior recorded time schedule (audio and text display) at a periodical schedule. The lighter ignition switch becomes active. The user action within next five minutes is one of the following:

a. Press Skip button. This operation results in: The software will "retain" the cigarette as a non-consumed one and reschedule it for the next scheduled time to light a cigarette b. Light a cigarette. This operation results in: The software will consider the cigarette as consumed and update the rest number of cigarettes for the rest of 24 hours as initially predefined in the data setup phase; and c. Do nothing. This operation results in: After 5 minutes the software will automatically skip the cigarette (refer to point a);

2. User presses the cheat button to light a cigarette at anytime, i.e. user does not wait for software to beep. This operation results in: The software will consider the cigarette as consumed and update the rest number of cigarettes for the rest of 24 hours as initially predefined in the data setup phase; and 3. User presses the friend button to light a cigarette for a friend. The lighter ignition switch becomes active. The software will not deduct any of the scheduled cigarettes.

The recorded data of the user not cheating is the indicator that announces that the user is conditioned i.e. he is lighting a cigarette only when getting an audio notification. At that point, the software will start reducing the number of audio alerts and eventually, the number of consumed cigarettes until the smoker quits smoking. Every five consecutive days without user cheating, the software will reduce the number of scheduled cigarettes by one cigarette. If the user remains in the conditioning phase and does not cheat, he/she will continue gradually to reduce the number of consumed cigarettes and eventually quit smoking. If the user is not able to keep up with the conditioning and uses the cheat button from time to time, the pace of smoke reduction will be slowed down allowing the user more time to adjust to the diminished pace.

Other data and information may be collected and provided for use in carrying out the system and method according to the invention, such as:

Software which calculates and stores in memory a set of information:

1. Statistics of cigarettes consumed per day/month/year since starting using the lighter/since starting the smoking habit 2. Progress line graph (a graph line between 0 and 100 that indicate the user progress in reducing smoking)

3. Number of cigarettes lighted for a friend

4. Number of cheats

5. Number of skips

6. Number of days of lighter use

All data can be saved and transferred using the USB port to the personal computer and linked to a website or websites, such as applicant's website, where he can save/share his personal data for himself or with a community.

Figure 4A:
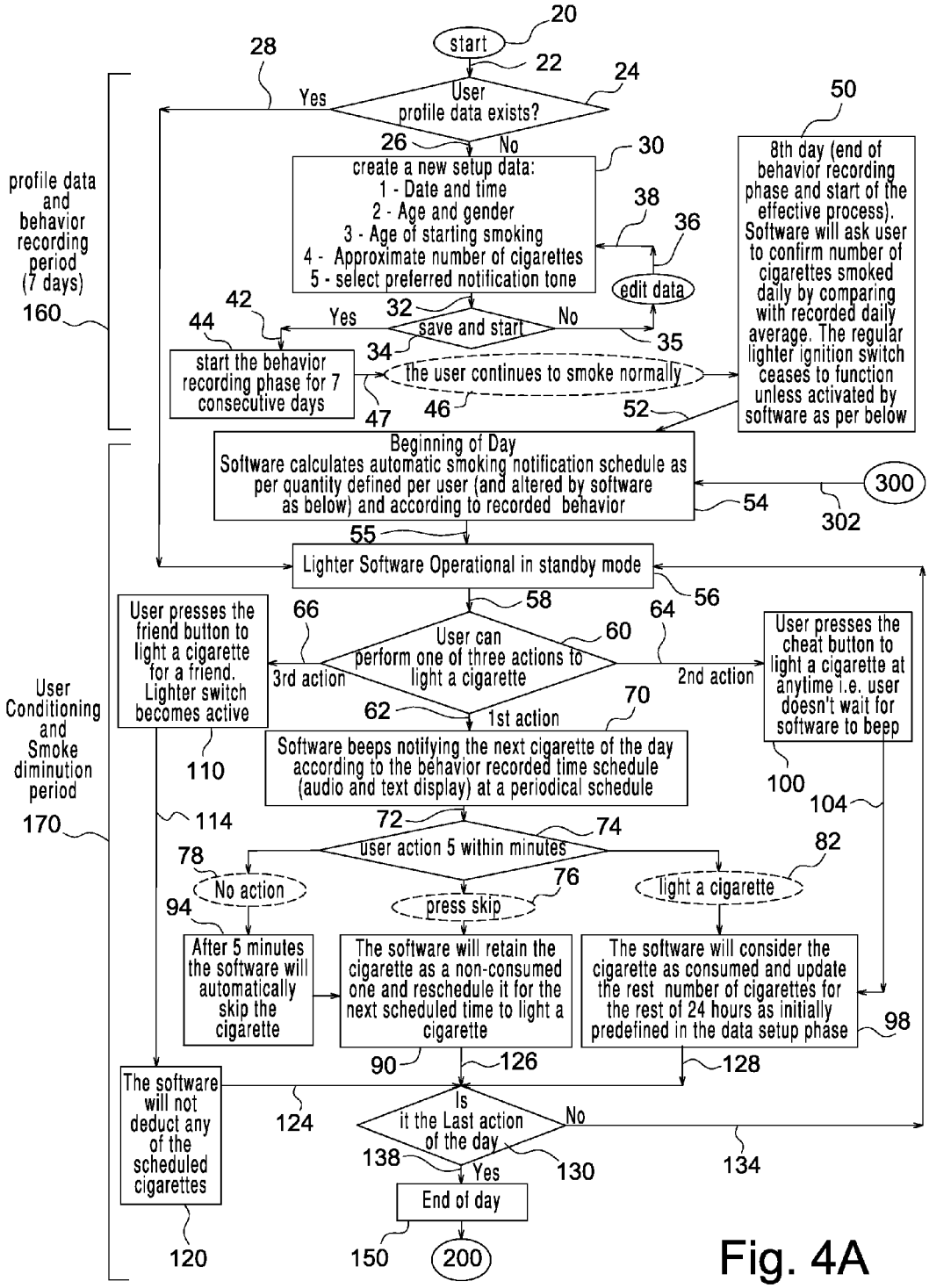
FIGS. 4A and 4B jointly illustrate an embodiment of a flow diagram illustrating the system and method incorporated in the embodiment of the handheld smoking elimination lighter of the embodiment of FIGS. 1-3, for example.
Figure 4B:
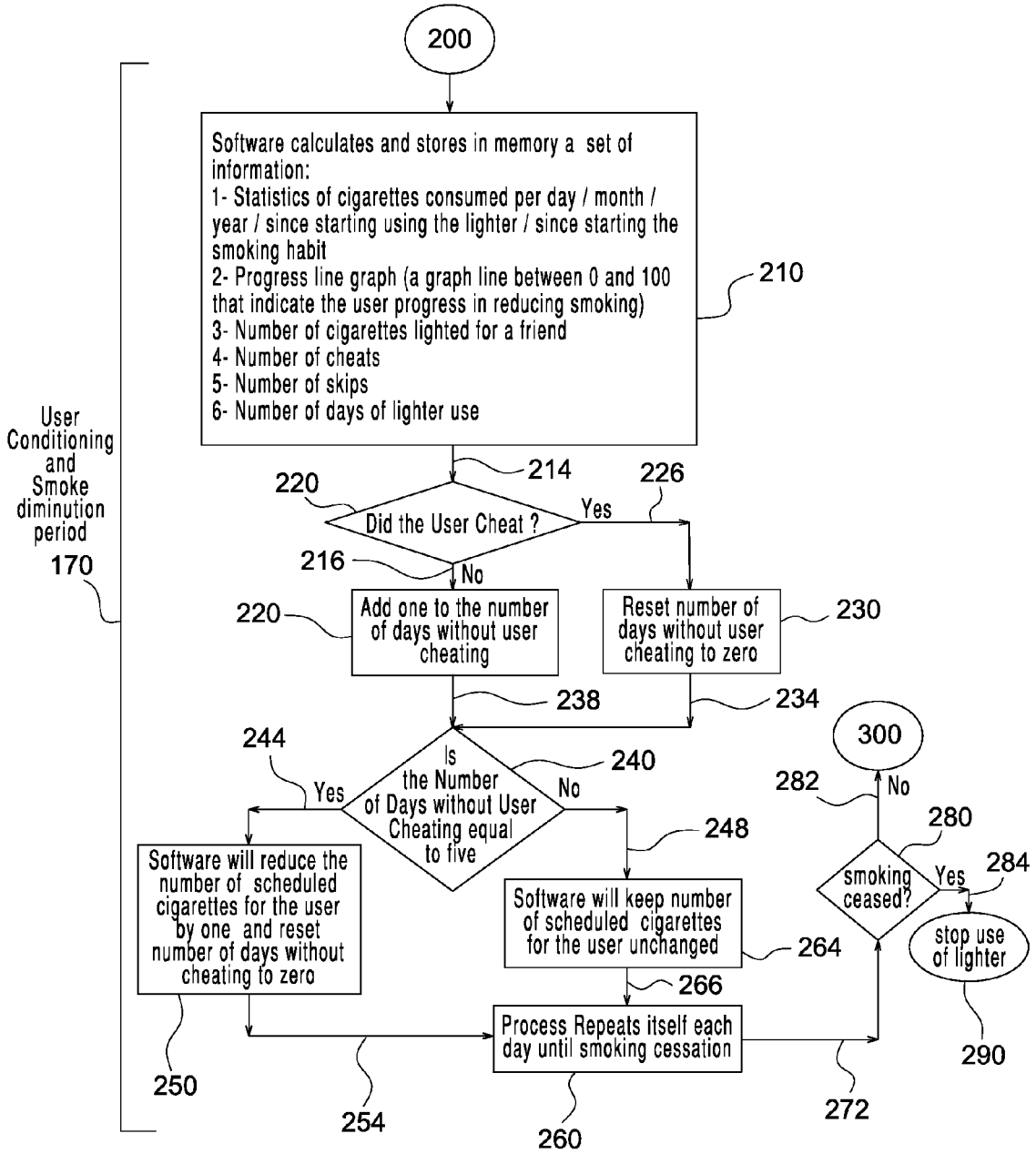

Flow Chart of FIGS. 4A and 4B

The flow chart of FIGS. 4A and 4B further illustrate the method and system according to the invention.

FIGS. 4A and 4B constitute a single flow chart. In general, it will be seen that the flow chart begins at a "start" step 20, and FIG. 4A is connected to FIG. 4B by a "step" or connector 200. FIG. 4B connects to FIG. 4A when the steps in accordance with the invention reach a "step" or connector 300. This will be further understood in connection with the detailed description of the logic steps of the flow chart of FIGS. 4A and 4B as follows.

The flow chart will be readily understood as an example of the logic of the learning software used with the FIGS. 1-3 embodiment of lighter L according to the invention, and can be understood before or after reading the above described embodiment of the invention.

As an overview, it is noted that the flow chart begins at a "start" operation or step 20 of FIG. 4A.

After the "end of day" step 150 has been reached in the FIG. 4A flow chart, one continues following the flow chart of FIG. 4B, as shown by connecting step "200" appearing on both FIGS. 4A and FIG. 4B. Then, if step "300" is reached, the flow of logic steps returns to FIG. 4A. Finally, when steps have occurred and the logic steps corresponding to the user quitting smoking have been reached, the "flow" ends by the illustrated logic step 260 of "process repeats itself each day until smoking cessation" and a step or query 280 "smoking ceased?" as shown on FIG. 4B immediately before connector or step 300 of FIG. 4B.

As to FIGS. 4A and 4B in detail, it will be seen that a user may start operation at start step 20 by initiating the learning software by pressing accept or enter button 4. Then, along a path 22 a logic query 24, such as the illustrated "user profile data exists?" may be displayed on display 2 to the user. If the answer to query 24 is NO, a logic path 26 is followed to a logic or flow chart step 30, such as the illustrated "create a new setup data:

1—date and time

2—age and gender

3—age of starting smoking

4—approximate number of cigarettes, and

5—select preferred notification tone" as shown in FIG. 4. That data in the form of answers from the user setting up the user profile data of logic block 24 for the first time may be entered by the user of enter button 4 and/or one or more directional buttons 3 which the user may use to move to different parts of display 2, as will be readily understood. After the new setup data has been entered in step 30, the flow chart will move along a logic path 32 to a "save and start" query 34 which may be displayed to the user. If the user is unsatisfied with some of the data entered, for example, then the answer to query 34 would be NO, and the flow chart would proceed along a path 35 to an edit data step 36, as shown. Then, along a path 38, the user would be returned to the step 30 for creating a new setup; i.e. the edited new setup after editing in step 36.

At that point, the logic in the flow chart would again proceed along path 32 to save and start query 34 until the user is satisfied that the entered data should be saved and the smoker cessation program should begin; i.e. the period of initially tracking and analyzing smoker behavior based on the smoker's tracked smoking habits, without any guidance or direction being provided to the smoker by the lighter as to when to smoke.

Thus, if the user is satisfied with the data, the user would enter "YES" and the flow chart would move along logic path 42 to the step 44 of "start the behavior recording phase for seven consecutive days". Then, the user would continue to smoke normally as shown in a flow chart step 46 as the logic path has moved along path 47. After seven days have been completed, which seven days may be counted automatically by the learning software used in accordance with the lighter L according to the invention, or the user may enter each day successively when the user's day has started. That will depend on the intended use of the lighter with learning software, such as on the expected user characteristics, or when a user moves from one time zone to another, such as while travelling, and the beginning and ending of a day would differ from the expected 24-hour period. On the eighth day, as shown by a step 50, which may be considered an "end of behavior recording phase and start of the effective process" the software will ask the user to confirm the number of cigarettes smoked daily by comparing the recorded daily average. At this point, the regular lighter ignition switch, fuel ignition actuator, or ignition actuator will cease to function as it has functioned unrestricted in the profile collection stage, and it will only function in accordance with the learning software as detailed below. That is, each use of the ignition actuator will be tracked. After step 50, as shown in the flow chart the software will advance along a flow chart along a path 52 to a step or phase 54, shown as "beginning of day software calculates automatic smoking notification schedule as per quantity [of cigarettes] per user (and altered by software as below) and according to the recorded user behavior." It may be seen that the software moves along a logic path 55 to a further step 56 shown as "lighter software operational and standby mode" that is to say, the lighter is now further into the period of conditioning the user and guiding the user in reducing the number of cigarettes smoked.

Going back briefly to the beginning of the flow chart above, if at the query 24 of "user profile data exists?" the user answer is YES, it will be seen that the software will, needless to say, bypass the various steps of creating a new data set for the user, and go directly to the step 56 of the lighter software being operational in its standby mode. This operational and standby mode 56 may be understood to mean that the user will be guided by the inventive lighter L, that is by the learning software thereof, as to when the user may light a cigarette for himself or herself, such being termed a "1$^{st}$ action" as the flowchart moves from a query or step 60 along a path 62. It will be appreciated that the first action leads to a step 70 of the software beeping, for example or vibrating, for notifying the user that the next cigarette of the day according to the learning software may be smoked. That is, according to the seven days of user recorded data.

The logic flow along path 72 goes to a user action or query step 74 indicating that the user may take action within a predetermined number of minutes, or a number of minutes determined during the user behavior recording period of seven days. Such may be an action within "5 minutes" as shown in FIG. 4A. At this point, the user may follow one or more steps or courses of action, such as an illustrated "press skip" step 76, a "no action" step 78, and a "light a cigarette" step 82.

In the case where the user decides that she is able to skip smoking the cigarette at this point in time, the user would press skip by pressing the skip actuator or button 8 of lighter L. Then, the software would be advanced to a logic point or step 90, as shown, at which the software may retain the cigarette as a non-consumed cigarette, and, for example, reschedule the cigarette for a next scheduled time for a user to be allowed to light a cigarette in accordance with the learning software of lighter L according to the invention.

In the case where the user takes no action, as shown at 78, the flow path will move to flow diagram block or step 94, as shown, indicating, for example that after "5 minutes the software would automatically skip the cigarette" again, the learning software may then consider such skipped cigarette as a non-consumed cigarette, as shown at step 90.

Still further, in the case where the user has been given five minutes in which to take an action with lighter L at query step 74, the user may choose the action of lighting a cigarette, as shown at step 82. When the user has lighted the cigarette in accordance with the user being alerted at step 70 that the user may light a cigarette at that time, the learning software will consider the cigarette as having been consumed. It will be noted that the user may light a cigarette by simply actuating the ignition actuator or button 1 of lighter L, as will be readily appreciated. After the cigarette has been lighted at step 82 and such has been taken into account in logic step 98, then along a logic path 128 a step will be reached at query 130 "is it the last action [i.e. cigarette] of the day". If the answer is NO to the query at 130, then a logic path 134 will return to the operational mode 56. At that point along a logic path 58 the software will be returned to a query step 60 and so forth.

Assuming that the answer was NO to the query at 130, and the user is now returned to logic query 60, and the user selects a "second action" as shown at path 64, as opposed to first action 62 as described above, then by choosing second action 64 the user; i.e. the learning software will be advanced to a block or step 100 on the flowchart as shown where the user may decide to press the "cheat" button 10 of lighter L so that the user can smoke a cigarette before the user has been directed that it is time to smoke a cigarette in accordance with the cigarette cessation, and the user wants to keep accurate data and has pressed cheat button 10 so that it is recorded as a consumed cigarette as shown at block 98. If that was not the last action of the day, again, the logic diagram would move along the NO path along path 134 back to block 56.

Now that the logic path has again reached query 60, it can be seen that the user may take, for example another first action 62, another second action 64, or a further "third" action "66", as shown which leads to a block or step 110 of the flowchart; namely, block 110 being the user pressing the friend button 9 of lighter L to light a cigarette for a friend, or stranger. By pressing friend button 9, followed by pressing of the ignition button 1, the learning software will not count such as being a cigarette smoked by the user. It is for that reason, that as shown along a path 114 the learning software has moved to a block 120 labeled as showing the "software will not deduct any of the scheduled cigarettes." That is because the user has indicated that the cigarette lit is for another person and was not a cigarette smoked for himself, which would have been indicated by the user first pushing the cheat button 10 as described in connection with block 100 above.

Again, in the case where the user has pressed friend button 9 at step 110 and the software has not counted such as a cigarette smoked by the user, as indicated at logic block 120, then the learning software is advanced along a logic path 124 again to query block 130 asking whether it is the last action of the day.

If the answer is NO then again the learning program will move the operation back to the operational mode 56, as described above. If the answer to the last action of the day query in query block 130 is YES, it will be seen that along logic path 138 the software will be instructed that it is the "end of day" as shown in logic block 150 for purposes of the learning software and smoking cessation.

As shown, it will be seen that the initial entering of user data as well as the collection of actual user data during an initial period, such as an initial seven day period, may be considered a profile data and behavior recording period 160, as shown.

It will further be seen that the period of use by the user, when the user is using lighter L to light cigarettes for himself and others, may be considered the user conditioning and smoking diminution period or smoker cessation period, as shown at 170.

For simplicity, at end of day logic block 150, it will be seen that a step or connector 200 is shown indicating how the logic paths of the flowchart of FIGS. 4A and 4B are connected. Connector 200 on FIG. 4A is the same as connector 200 on FIG. 4B.

In other words, after the end of the day 150, it may be seen on FIG. 4B that a further logic block 210 in which the software calculates and stores in memory a set of information it may be provided for updating the cigarette use for the day which has just been completed as of the end of day logic block 150. As detailed in logic block 210, at this point, the learning software in accordance with the invention calculates and stores in memory a set of information, such as:

1. statistics of cigarettes consumed per day/month/year/since starting using the inventive lighter/since starting one's smoking habit;
2. progress line graph, such as a graph showing progress between 0 and 100 that indicates the user's progress in reducing the number of cigarettes, so that the user may see, such as on display 2 of lighter L, the user's progress in the form of a descending line showing the cigarettes smoked have been reduced over time;
3. the number of cigarettes lighted for a friend;
4. the number of cheats indicated by use of cheat button 10;
5. the number of skips indicated by the user's using skip button 8; and
6. the number of days of lighter use, as calculated by the learning software of lighter L according to the invention.

These calculations may be done at the end of the day, or indeed, as will be appreciated, throughout the day depending on the intended use. After the updates of user data and statistics as shown in block 210, the software will move along a logic path 214 to a query block 220; namely, "did the user cheat?" If the answer is YES, then the learning software will move along the path 226 to block 230 as shown, block 230 being a logic step of resetting the number of days the user has used lighter L without cheating to zero (0).

Then, along a path 234 a next logic query 240 will be reached, that is, a logic query "is the number of days without user cheating equal to five" to which the answer will either be YES or NO.

Going back to the query 220 "did the user cheat?", if the logic answer had been NO, then the learning software would have moved to logic block 220 in which the step is performed of adding one (1) to the number of days which the user has gone without cheating; i.e. without using cheat button 10 of lighter L. Then, along a path 238 the software logic will be moved to query 240. If the answer to query 240 is YES; that is, the user has gone five days without cheating, then along a path 244 the software will advance to a step 250 of reducing the number of scheduled cigarettes for user by one and resetting the number of days of cheating to zero. That step 250 is performed because, for example, based on the user's smoking habits measured during the profile data and behavior recording period 160 above, it has been determined based on the queries and logic built into the learning software according to the invention, that after five days without cheating, the user should likely be able to smoke one fewer cigarettes per day. This is one of the aspects of the invention which lead to an overall reduction of cigarettes smoked until the point is reached at which the smoker is no longer smoking any cigarettes per day. After block 250, the software moves along a path 254 to step 260 of the process repeating itself each day until smoking cessation has been achieved.

Going back to logic query 240 regarding the number of days the user has gone without cheating, if the answer is NO to the query has the user gone five days without cheating, then along a logic path 248 the software moves to a step 264 in which the learning software keeps the number of scheduled cigarettes for the user unchanged. That, again, is based on the analysis of user's smoking behavior recorded by the smoker himself at setup block 30, and the measured user behavior of period 160 outlined above. In brief, the learning software decision has been made that if the user has been unable to use the lighter for five days without cheating, then the user is not ready for the number of cigarettes allowed per day to be reduced.

Then, after that step 264, along a path 266 the software returns to step 260 of the process repeating itself each day until there is smoker cessation.

As shown, after that step 260, one may consider this software to have reached a logic query 280 of "has smoking ceased?" If the answer is YES, then the software takes a path 284 to the final step 290 of stopping use of lighter L. It will be appreciated that the user may be provided with that decision and direction on display 2 of lighter L. If the answer to query 280 is NO, then the software moves along a path 282 back to the "beginning of a [new] day" as shown at step 54 of FIG. 4A. As will be readily apparent, that has been reached thanks to connector 300 connecting the two Figures together, as will be readily appreciated, and logic paths 282 and 302 may be considered one and the same.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention.

What is claimed is:

1. A smoking cessation lighter, comprising:

a) a lighter configured for lighting cigarettes for a smoker; and b) a learning software provided and operatively associated with the lighter for monitoring smoking behavior of a smoker during a first data collection period and guiding a smoker's smoking diminution and cessation behavior by directing the smoker when the smoker is to smoke a cigarette based on data collected during the first data collection period; and c) the learning software is configured for monitoring user behavior and further collecting data during the use of the lighter by the smoker after the initial data collection period in order to analyze and further guide the smoker based on the smoker's cheating behavior, and the smoker's behavior of lighting a cigarette for a friend, and the smoker's behavior of skipping use of the lighter to light a cigarette for the smoker at a time when the smoker has been directed to light a cigarette.

2. A smoking cessation lighter as in claim 1, wherein:

a) the learning software is provided in the lighter.

3. A smoking cessation lighter, comprising:

a) a lighter housing;

b) a fuel supply receptacle and an ignition actuator provided on the lighter for igniting fuel for lighting a user's cigarette;

c) a learning software provided in the lighter housing and being operatively associated with the ignition actuator for directing the user when to use the ignition actuator, for recording when the user has used the ignition actuator when the user has been directed to use the ignition actuator, and for tracking the user's use of the ignition actuator for lighting a cigarette when the user has not been directed to use the ignition actuator;

d) the ignition actuator being operatively associated with the learning software for tracking, recording, and monitoring user smoking behavior by receiving, analyzing, and storing lighter use by receiving and analyzing ignition actuator use, behavior recorded and analyzed including:

i) using the ignition actuator to light a user's cigarette when directed by the learning software;

ii) using the ignition actuator to light a cigarette for another when directed by the user; and iii) using the ignition actuator to light a user's cigarette when directed by the user at a time other than when directed by the learning software to light a cigarette.

4. A smoking cessation lighter as in claim 3, wherein:

a) the behavior recorded and analyzed includes smoking behavior data provided by the user in a database.

5. The smoking cessation lighter as in claim 3, wherein:

a) the learning software includes software for tracking smoker behavior for a first period of time to provide a database of user's smoking behavior data.

6. A smoking cessation lighter as in claim 3, wherein:

a) providing a display to display user smoking behavior data and user instructions.

7. A smoking cessation lighter as in claim 3, wherein:

a) a cheat actuator is provided on the lighter and is operatively connected with the learning software.

8. A smoking cessation lighter as in claim 3, wherein:

a) a display is provided on the lighter and is operatively connected with the learning software, and the learning software provides an instruction on the display for the user to smoke a cigarette.

9. A smoking cessation lighter as in claim 3, wherein:

a) the user using the ignition actuator to light a user's cigarette when directed by the user at a time other than when directed by the learning software to light a cigarette is recorded by the learning software as a user cheating behavior.

10. A smoking cessation lighter as in claim 3, wherein:

a) a skip button is provided on the lighter and is operatively connected with the learning software.

11. A smoking cessation lighter as in claim 3, wherein:

a) a friend button is provided on the lighter and is operatively connected with the learning software.

* * * * *